United States Patent [19]

Desplats

[11] 4,316,602

[45] Feb. 23, 1982

[54] DEVICE FOR PRESSING A CABLE AGAINST THE BOTTOM OF A PULLEY GROOVE

[75] Inventor: André Desplats, Boulogne Billancourt, France

[73] Assignee: Tractel S.A., France

[21] Appl. No.: 68,812

[22] Filed: Aug. 22, 1979

[30] Foreign Application Priority Data

Jun. 1, 1979 [FR] France ..... 79 14188

[51] Int. Cl.[3] ..... B66D 1/48; B66D 1/58

[52] U.S. Cl. ..... 254/270; 104/173 R; 104/230; 254/333

[58] Field of Search ..... 254/270, 273, 287, 333, 254/216; 187/11, 22, 27; 104/127, 173 R, 173 ST, 230, 231, 234

[56] References Cited

U.S. PATENT DOCUMENTS

| | | | |
|---|---|---|---|
| 268,068 | 11/1882 | Wythe | 254/287 |
| 2,662,732 | 12/1953 | Allenbaugh | 254/333 X |
| 2,917,278 | 12/1959 | Arnold | 254/333 X |
| 3,405,651 | 10/1968 | Harmon | 104/173 ST |
| 4,139,178 | 2/1979 | Hippach | 254/333 X |

*Primary Examiner*—John M. Jillions

*Attorney, Agent, or Firm*—William A. Drucker

[57] ABSTRACT

The hoisting apparatus comprises a device for pressing a roller or a train of rollers against a cable section engaging a driving pulley in order to improve the adherence of the cable to the pulley groove which is caused by the load; this device comprises a linkage fulcrumed at one or more points to the main support of the driving pulley, one end of the linkage carrying the roller or train of rollers while the other end is utilized for anchoring the load to the support.

4 Claims, 1 Drawing Figure

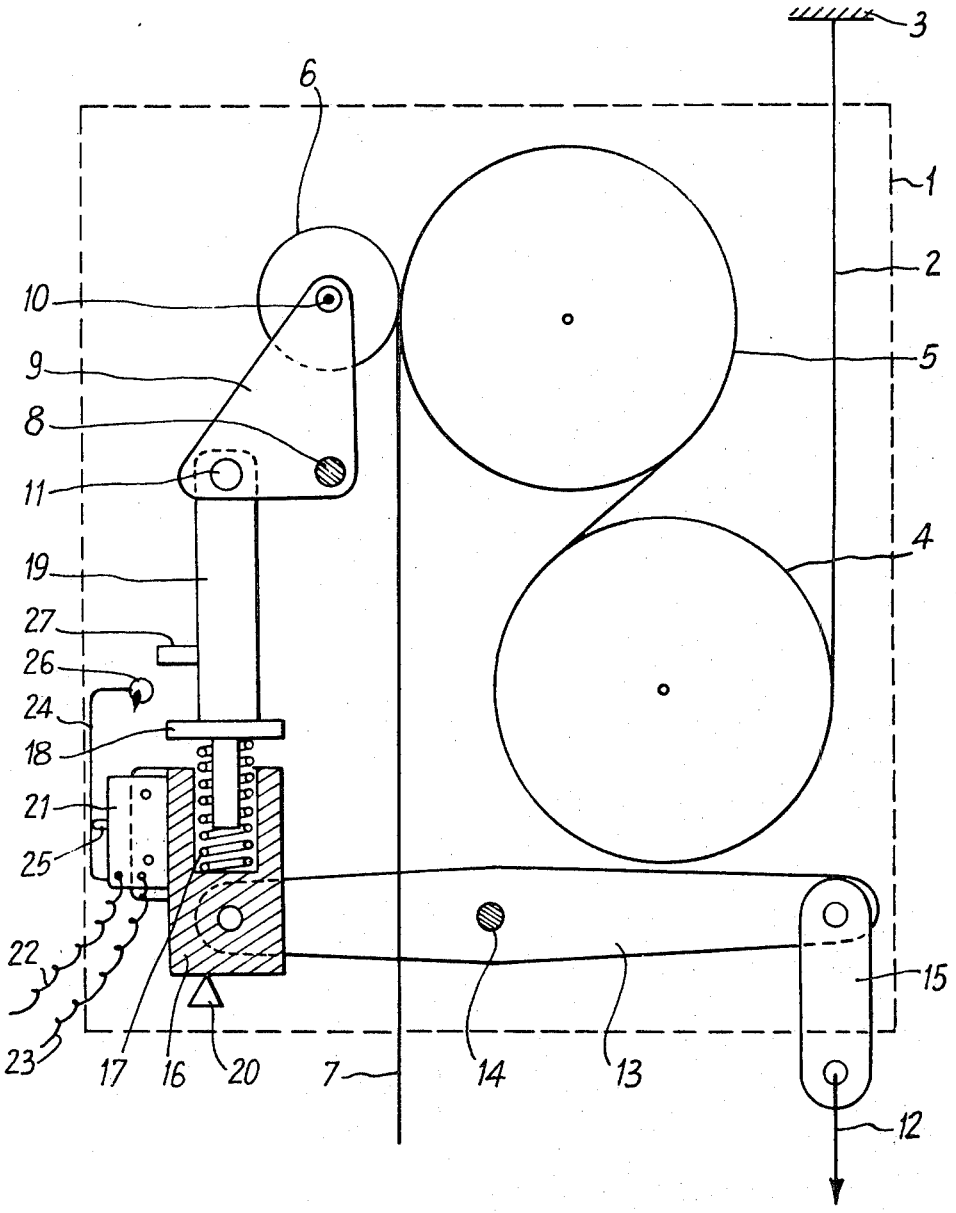
3
6
1
2
10
9
5
8
11
4
19
27
26
24
18
21
25
22
23
17
16
20
7
14
13
15
12

DEVICE FOR PRESSING A CABLE AGAINST THE BOTTOM OF A PULLEY GROOVE

BACKGROUND OF THE INVENTION

1. Field of the Invention

This invention relates in general to cable-type hoisting and traction apparatus in which the cable is driven as a consequence of its adherence to a pulley, which results from means pressing this cable against the walls of the groove.

2. Description of the Prior Art

In known apparatus of this character, this driving pressure is provided either by spring means, and in this case the pressure has a fixed value irrespective of the load, or preferably by one or more rollers coupled to a lever mechanism responsive to the position of a deflection pulley engaging the taut cable section tensioned by the load.

In this last case, and for this purpose, the deflection pulley is pressed against the cable tensioned by the load so that a component of this load, applied to the taut cable section, exerts on this deflection pulley an action causing the lever mechanism to press the roller or the set of rollers against the cable, thus providing the desired adherence of this cable to the bottom of the groove of the driving pulley.

However, this know arrangement is objectionable in that it requires the use of a deflecting pulley arranged according to couplings other than the kinematic connections transmitting the drive from the power unit to the load. Now this pulley not only constitutes an additional component element of which the over-all dimensions are incremented, in certain cases, by the necessity of meeting certain safety rules, but exerts on the cable a wearing action not partaking in the driving action. Finally, the safety of operation of the driving system is dependent upon the proper cooperation between the deflection pulley and the taut end of the cable.

SUMMARY OF THE INVENTION

It is the primary object of the present invention to provide a cable pressing system which, under the action of the load, is responsive to the movement of the point whereat the load is anchored to the hoisting apparatus.

Thus, the cable pressing system is interposed directly in the kinematic chain connecting the power member to the load. Now this arrangement is not only more reliable and less cumbersome, but also capable of detecting a possible overload and stopping the motor as a consequence of this detection.

An arrangement according to this invention is applicable both to single-pulley apparatus and to multi-pulley apparatus, and notably to a twin-pulley apparatus. For the sake of clarity, the multi-pulley arrangement will be assimilated to that of several pulleys having each several grooves engaged by the cable.

Finally, this system is applicable to a cable engaged in a pulley groove having anyone of several possible groove cross-sectional contours, either in the case of a single pulley or in the case of several pulleys. More particularly, this system is applicable to a pulley having a V-shaped groove.

In order to afford a clearer understanding of this invention reference will now be made to the single FIGURE of the accompanying drawing illustrating diagrammatically by way of example the essential elements necessary for this understanding.

DESCRIPTION OF THE PREFERRED EMBODIMENT

In the drawing, the reference numeral 1 designates the main support of a hoisting apparatus comprising two grooved pulleys suspended through the taut portion 2 of the hoisting cable from an anchorage point 3 from which the cable is wound in succession around wedging pulleys 4 and 5 while being pressed into the groove of pulley 5 by means of a presser roller 6, the free section (i.e. the slack section) of the cable being shown at 7.

The support 1 carries the shafts of the two pulleys and the motor or power unit (not shown) driving at least one of the two pulleys. This support 1 further carries the pivot pin 8 of a right-angle triangular member 9 supporting in turn the pivot pin 10 of presser roller 6 urged towards the bottom of the groove of pulley 5, and the pivot pin 11 actuated by the load through a transmission mechanism enables this pivot pin 11 to transmit in turn a tightening pressure increasing with the load to the presser roller 6, as will be explained presently.

The above-mentioned transmission mechanism, disposed between the pivot pin 11 and the load designated diagrammatically by a force 12, comprises a two-armed lever 13 fulcrumed intermediate its ends to a pivot pin 14 carried by the support 1 of the hoisting apparatus. At one end, the lever 13 carries the load 12, for example through the medium of a suspension link 15, and the opposite end of lever 13 is pivotally connected to a lower strap 16 of a coil compression spring 17 reacting against its upper strap consisting of a shoulder 18 formed on a thrust rod 19 pivotally connected by means of its pivot pin 11 to the pivoting triangular member 9 so that the force exerted on the thrust rod 19 will be transmitted to said member 9 and to the presser roller 6 in the direction to increase the tightening action of this presser roller 6 against the cable passing around the pulley 5.

Since the spring 17 is interposed between the straps 16 and the thrust rod 19, it constantly urges these members away from each other by pushing the strap 16 against a stop 20 rigid with the support 1 of the hoisting apparatus, so that, even when no load is supported by the cable, a pre-tightening force is exerted on the presser roller 6. The presence of a load causes a vertical force to be exerted on the strap 16 as a consequence of the rotation of lever 13, so that this strap 16 will be moved away from stop 20 when this vertical force due to the load exceeds the compressive force of the spring which corresponds to the pre-tightening force exerted by the presser roller 6. The spring 17 is thus compressed more strongly and will apply a greater tightening force increasing with the load, this spring force being dependent upon the load which is thus measured by the spring 17 acting as a balance spring.

Furthermore, the compression of spring 17 may be utilized for detecting an overload and then control the stopping of the electric motor driving the pulleys 4, 5 of the hoisting apparatus. In the drawing, there is illustrated diagrammatically a device suitable for overload detecting purposes and stopping the motor. The lower strap 16 carries laterally a switch box 21 to which a pair of conductors 22, 23 for closing the energizing circuit of the electric motor are led, the switch proper consisting of a vertical flexible blade 24 electrically connected to one of the conductors 22, 23 and engaging in the inoperative position and under normal service conditions a fixed contact 25 connected to the other conductor. The movable blade 24 of the switch is provided with an upper extension carrying a roller 26 which, in case of overload corresponding to a predetermined compression of spring 17, engages a cam or ramp 27 carried by the thrust rod 19 so that this cam or ramp will move the blade 24 away from the fixed contact 25, thus causing the motor to be de-energized and stopped automatically in case of overload.

Of course, various modifications and changes may be brought to the form of embodiment of the invention shown diagrammatically by way of example herein, without inasmuch departing from the basic principles of the invention as set forth in the appended claims.

What I claim is:

1. A hoisting apparatus comprising:

(i) a support (ii) a driving pulley rotatable about a pivot on said support and having a peripheral groove (iii) a cable having one of its ends secured to an anchorage point and being passed about said driving pulley and having its other end slack (iv) a first lever pivotable about a pivot on said support (v) at least one roller carried rotatably on said first lever and engaging said cable to press it into the peripheral groove thereof (vi) a two-arm second lever pivoted on said support, said two arm lever having one of its arms connected to a suspension means for a load, said two-arm lever having the other of its arms connected to a strap, (vii) a thrust rod connected to said first lever (viii) a compression spring having a first end acting on said strap and a second end acting on said thrust rod, and (ix) a stop on said support against which said strap is urged by said compression spring when said second lever is under no-load or low-load condition, whereby under no-load and low-load condition said compression spring acts through said thrust rod and first lever to urge said at least one roller to press said cable into the peripheral groove of the driving pulley, and under greater load condition said second lever is moved to move said strap away from said stop and compress said spring so as to transmit to said at least one roller a cable pressing force which increases with the load applied.

2. A hoisting apparatus, according to claim 1, comprising an electric driving motor coupled to said driving pulley, and switch means in a current supply circuit for said driving motor, said switch means including first and second contact elements carried on said strap, said contact elements being normally closed, and an abutment on said thrust rod positioned such that, when said compression spring is compressed to a predetermined extent, said abutment is abutted by said first contact to cause said contacts to open and cut off current supply to the motor.

3. A hoisting apparatus, as claimed in claim 1, wherein the peripheral groove of said driving pulley has a V-shaped cross-section.

4. A hoisting apparatus, as claimed in claim 1 comprising at least one further pulley coplanar with said driving pulley and rotatable about a pivot on said support, said cable being passed about said at least one further pulley between said anchorage point and said driving pulley.

* * * * *